United States Patent [19]

Hirakawa et al.

[11] Patent Number: 4,667,953

[45] Date of Patent: May 26, 1987

[54] SHEET STACKER

[75] Inventors: Tadashi Hirakawa; Masashi Waseda; Toshiaki Kusubayashi; Isao Tokumaru, all of Mihara, Japan

[73] Assignee: Mitsubishi Jukogyo Kabushiki Kaisha, Tokyo, Japan

[21] Appl. No.: 769,335

[22] Filed: Aug. 26, 1985

[51] Int. Cl.[4] ..... B65H 29/18

[52] U.S. Cl. ..... 271/280; 83/80; 83/88; 198/577; 198/462; 271/182; 271/199; 271/202; 271/216; 271/217

[58] Field of Search ..... 271/198, 199, 200, 201, 271/202, 203, 214, 215, 216, 217, 182, 280, 258; 414/901, 69, 45, 86; 83/88, 79, 80; 198/836, 462, 369, 577, 579

[56] References Cited

U.S. PATENT DOCUMENTS

| | | | |
|---|---|---|---|
| 2,673,735 | 3/1954 | Niles et al. | 271/217 |
| 2,707,142 | 4/1955 | Waite | 271/215 |
| 3,507,489 | 4/1970 | Wilshin et al. | 271/182 |
| 3,729,188 | 4/1973 | Stephanson | 271/217 |
| 3,998,141 | 12/1976 | Hsiue | 271/182 |
| 4,040,618 | 8/1977 | Vermes et al. | 271/217 |
| 4,111,411 | 9/1978 | Graves et al. | 414/50 |
| 4,188,861 | 2/1980 | Kroeze et al. | 271/203 |
| 4,424,966 | 1/1984 | Chandoke | 271/182 |

*Primary Examiner*—Richard A. Schacher

*Attorney, Agent, or Firm*—Wenderoth, Lind & Ponack

[57] ABSTRACT

A sheet stacker for a corrugation machine having a cutter to widthwisely cut off a continuously manufactured corrugated cardboard web into corrugated cardboard sheets, and then transfer, stack and eject the sheets. The sheet stacker comprises: a shingling conveyor arranged downstream of an outlet of the cutter for shingling the sheets; braking apparatus arranged above the shingling conveyor for braking the sheets transferred from the cutter; a first transfer conveyor arranged downstream of the shingling conveyor and which is vertically pivotable about its end portions on the upstream side thereof; a stopper disposed between the shingling conveyor and the first transfer conveyor for selectively stopping the sheets; at least one second transfer conveyor arranged in the downstream of the first transfer conveyor; a sheet stacking mechanism disposed downstream of the second transfer conveyor and which is vertically movable for receiving and stacking the sheets discharged from the second transfer conveyor; a drive mechanism for moving the sheet stacking mechanism up and down at a variable speed; and an adjustment mechanism for controlling the drive mechanism in response to the magnitude of a sheet stacking speed to thereby adjust a descent speed of the sheet stacking mechanism.

10 Claims, 14 Drawing Figures

SHEET STACKER

FIELD OF THE INVENTION

The present invention relates to a sheet stacker which is installed after the final step of a corrugation machine during which a corrugated cardboard web which has been continuously manufactured is cut in a transverse direction by means of a cutter into corrugated cardboard sheets. The sheeet stacker of the invention is effective to transfer and stack the cut-off sheets, and then eject a stack of sheets whenever they are stacked in a predetermined number.

BACKGROUND OF THE INVENTION

A conventional sheet stacker will be described by referring to FIG. 1. A corrugated cardboad web 101 which has been continuously manufactured through various preceding steps is cut off into several thinner sheets in the direction of advancement and, thereafter, widthwisely cut off by means of a cutter 102 at intervals of a predetermined length into corrugated cardboard sheets 103. The sheets 103 are discharged from a cuter outlet by a conveyor 104 to a shingling conveyor 105 which is driven at a lower speed than the former conveyor 104, so that the singled or overlapped sheets (in the form of stacked roofing slates) are fed onto a transfer conveyor 106. A plurality of braking members such as brushes, leaf springs or free rollers are disposed above the shingling conveyor 105 to restrain advance of the sheets. Because the sheets are cut off by means of the cutter to any desired length usually in a range of 500–5000 mm, the braking members are manually adjusted between their operative and inoperative modes depending on the length of the sheets.

The sheet 103 is discharged onto a sheet stacking table 107 through the transfer conveyor 106. More specifically, the discharged sheet 103 strikes against a front plate 109 and drops downward to be stacked on the sheet stacking table 107 in sequential order. The sheet stacking table 107 is driven up and down by a motor 110 through sprockets 111, 112 and chains 113, 114, 115. An upper end level of the sheets stacked on the table 107 is detected by a photoelectric tube 108. When the sheets 103 interrupt an optical path of the photoelectric tube 108, the motor 110 is driven and, when they do not interrupt the optical path, the motor 110 is stopped. Thus, the motor 110 is controllably driven so that the distance a that the sheets fall from the transfer conveyor 106 is kept substantially constant. Designated at 116 is a limit switch which is actuated upon downward movement of the table 107 for stopping the motor 110.

In such a conventional sheet stacker, the braking members must be manually moved up and down for each order change to vary a length of the sheets 103. This manual setting is troublesome and often not in good timed relationship with the order change. If not in good timed relationship, the sheets just after change in length are not favorably braked, with the result that they may be disordered, folded or travel too fast and hence became jammed.

The corrugated cardboard sheet 103 to be manufactured is divided into several types having different thicknesses of 3 mm, 5 mm and 9 mm, for example, depending on the size of corrugations, and the number of sheets discharged from the transfer conveyor 106 onto the table 107 is largely varied in accordance with the manufacturing speed and length of the sheets.

Meanwhile, the descent speed of the sheet stacking table, i.e., a rotational speed of the motor 110, must be large enough to be capable of following handling the maximum capacity of stacked sheets. Since the descent speed of the table is so set in the above sheet stacker, the table descent speed becomes too large for the normal amount of stacked sheets and descending of the table can not be stopped with fine enough control, thus resulting in a larger fall distance a. With the increased fall distance a, the dropping sheets are more largely disordered so that they are not stacked on the table in a neat order but instead are stacked in a random state. Such a random state gives rise to the problems that the stacked sheets are liable to break and the projecting portions of the sheets may be damaged, when transferred to the next step, and that handling of the sheets in the next step becomes difficult and automization of the handling is hampered due to the resulting difficulty.

Furthermore, the corrugated cardboard sheets manufactured by a corrugation machine include various types of defective sheets which are caused through the manufacturing process as a result of failed bonding, curvature, worn-out edge, stains, scratches, etc. If these defective sheets are mixedly stacked in with the good sheets at the stacker section as the final step of a corrugation machine, a difficulty is encountered in operation such as fabricating the sheets into boxes, or putting them into print. Accordingly, the defective sheets must be removed during the operations of a corrugation machine. Heretofore, the defective sheets have been visually checked and then withdrawn by an operator. This method is favorably effective for a small amount of defective sheets. According to circumstances, howevr, a large amount of defective sheets may be produced. In such a case, it is very troublesome to remove the defective sheets by hands and the machine must be often stopped for removal thereof. To cope with this, there has also been conceived an apparatus for automatically removing the failed sheets. But, because of the needs of detecting the varius types of defective sheets as well as very high-graded detection techniques, the conceived apparatus is practically infeasible from both technical and economic standpoints.

SUMMARY OF THE INVENTION

It is an object of the present invention to provide a sheet stacker which is capable of automatic control and hence fit for high-speed operation.

Another object of the present invention is to provide a sheet stacker in which braking means can be automatically set in response to change in cut-off length of sheets.

Still another object of the present invention is to provide a sheet stacker which is capable of removing the failed sheets simply and positively.

A further object of the present invention is to provide the sheet stacker which is capable of finely controlling a descent of sheet stacking means to thereby ensure a proper stack of sheets.

Additional objects and advantages will be apparent from the following detailed description.

DETAILED DESCRIPTION OF THE PREFERRED EMBODIMENTS

Hereinafter, one embodiment of the present invention will be described with reference to the drawings.

Figure 1:
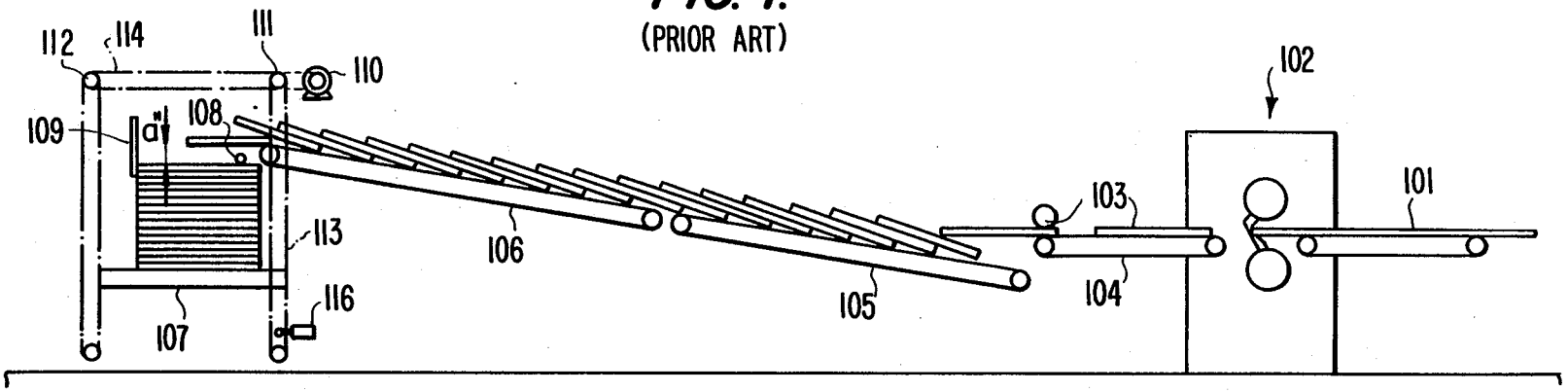
FIG. 1. (PRIOR ART)
FIG. 1 is a side view showing the schematic constitution of a conventional sheet stacker.
Figure 2:
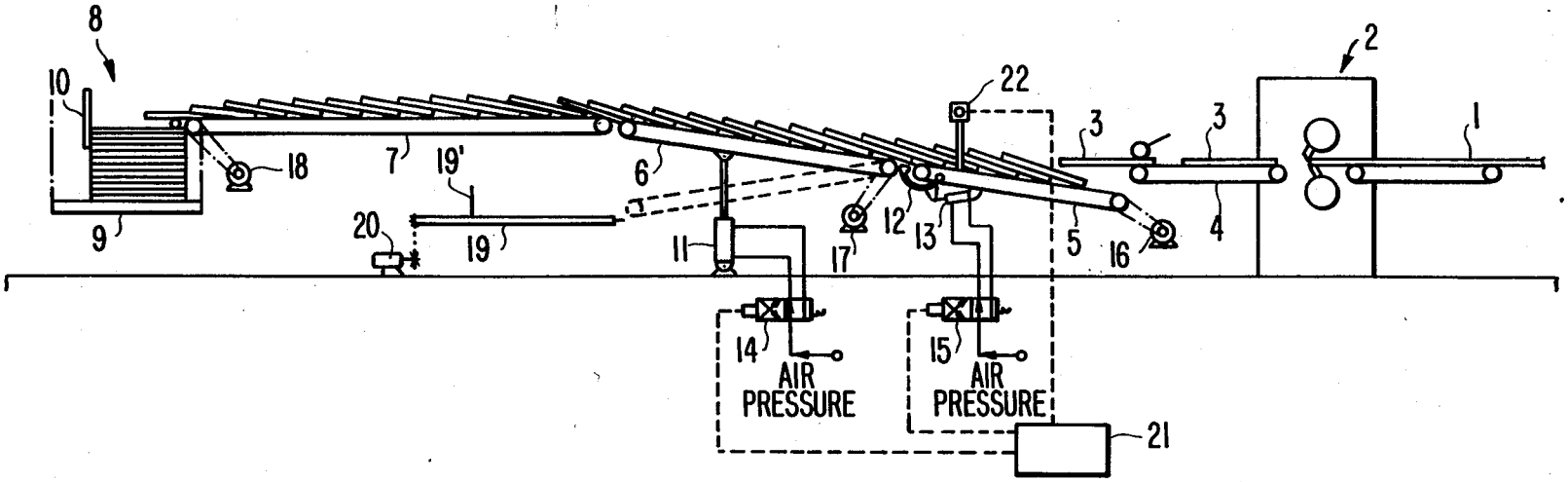
FIG. 2 is a side view showing the schematic constitution of a sheet stacker according to one embodiment of the present invention.
Figure 3:
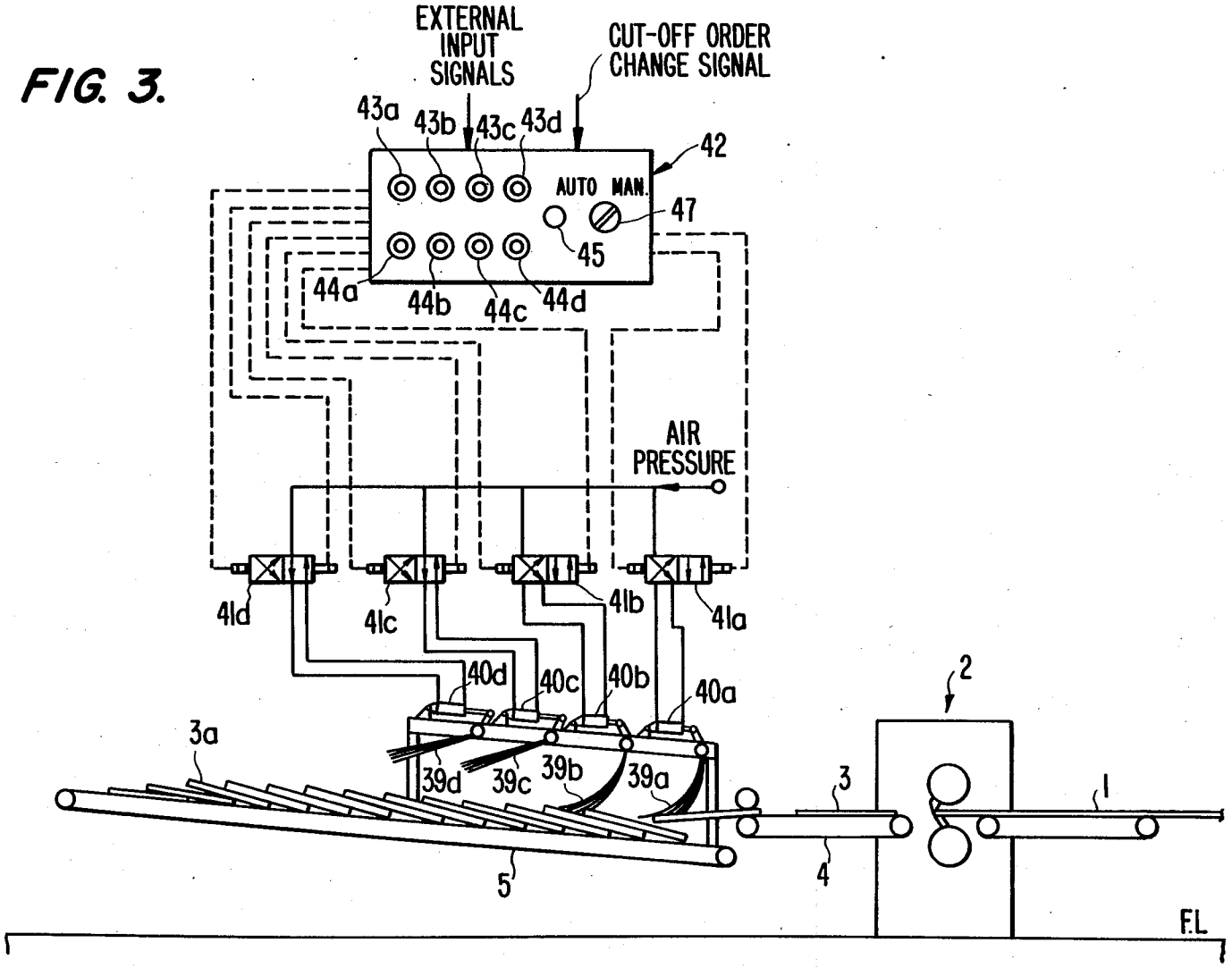
FIG. 3 is an explanatory side view showing a shingling conveyor section in detail.
Figure 4:
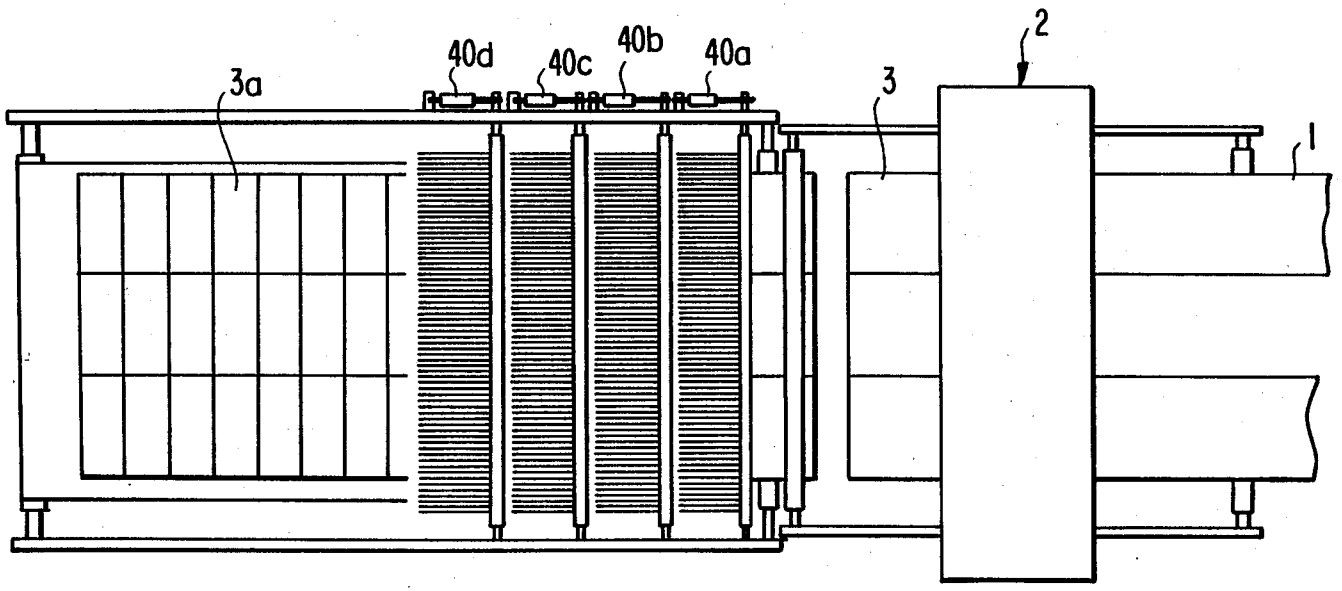
FIG. 4 is a plan view of FIG. 3.
Figure 5:
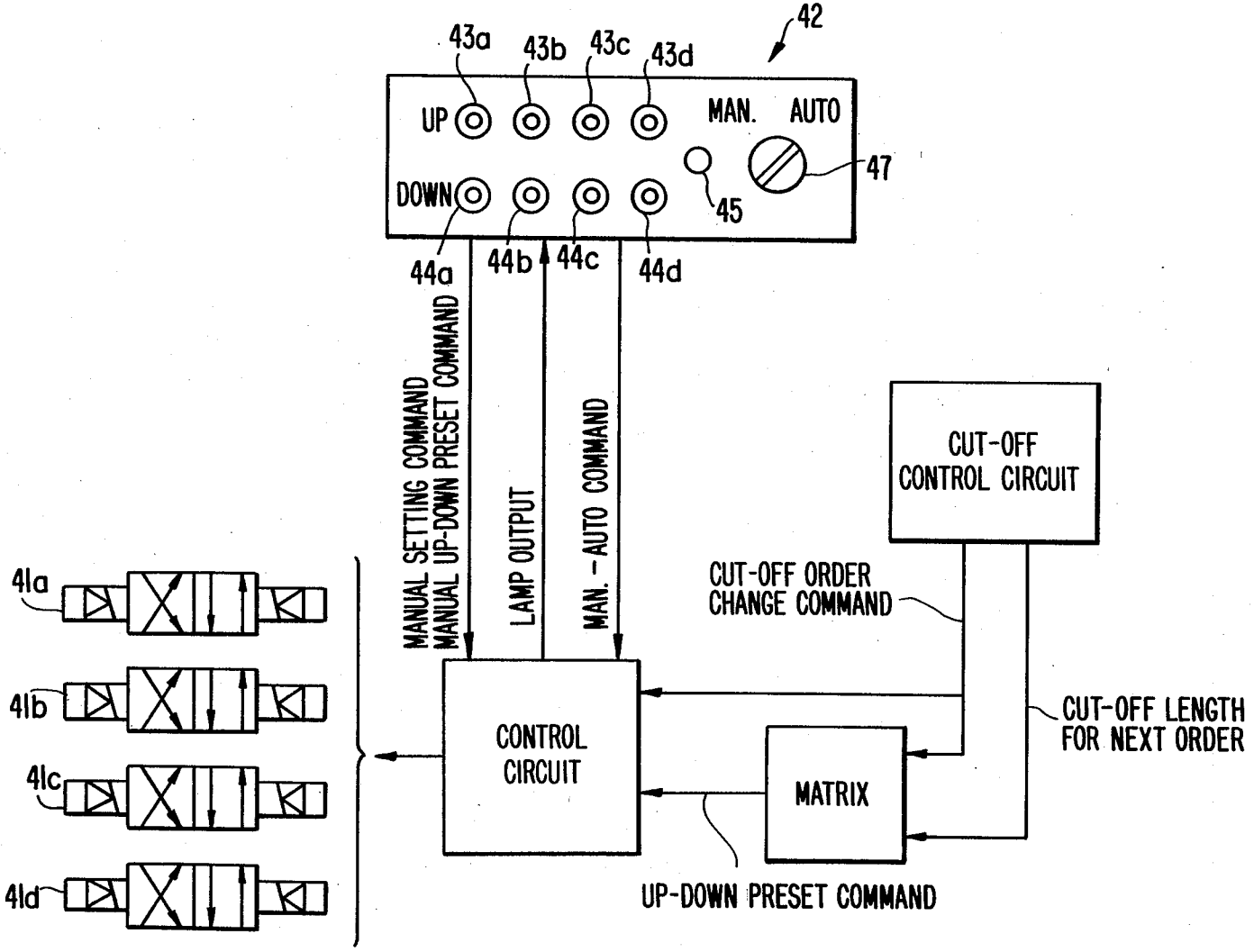
FIG. 5 is an explanatory block diagram for explaining control of brushes.

Referring first to FIG. 2, designated at 1 is a corrugated cardboard web manufactured through various preceding steps, 2 is a cutter for cutting off the corrugated cardboard web 1 with intervals of a pedetermined length, 3 is a corrugated cardboard sheet having been cut off, 4 is a cutter outlet conveyor for carrying the sheet 3, 5 is a shingling conveyor which is disposed on the downstream side of the cutter outlet conveyor 4 and driven at a lower speed than the conveyor 4 to a shingle or overlap a plurality of sheets 3 (i.e., stack the sheets into the form of roofing slates), 6 is a conveyor, 7 is a second conveyor, and 8 is a stacker section for stacking the sheets 3 therein. The stacker section 8 includes a front plate 10 for stopping advance of the sheets 3 and a vertically movable table 9 for stacking sheets thereon. The first conveyor is movable vertically by means of a pivotable connection about its both lateral ends near the shingling conveyor 5 upon extension and contraction of an air cylinder 11. Designated at 12 is a stopper which is pivoted upon extension and contraction of an air cylinder 13 so that the left end of the stopper 12 can project into and retract from a sheet transfer path. The shingling conveyor 5, the first conveyor 6 and the second conveyor 7 are separately driven by DC motors 16, 17 and 18, respectively. A discharge conveyor 19 having a stop 19' thereon is disposed below the second conveyor 7 for discharging defective sheets and is driven by a motor 20. A solenoid valve 14 is provided for extending or contracting the air cylinder 11, and 15 designates a solenoid valve for extending or contracting the air cylinder 13. A control panel 21 is employed for controlling operations of the solenoid valves 14, 16 and the motors 16, 17, 18, 20. A push button unit 22 is disposed near the shingling conveyor 5 to instruct operation of the control panel 21.

Figure 6:
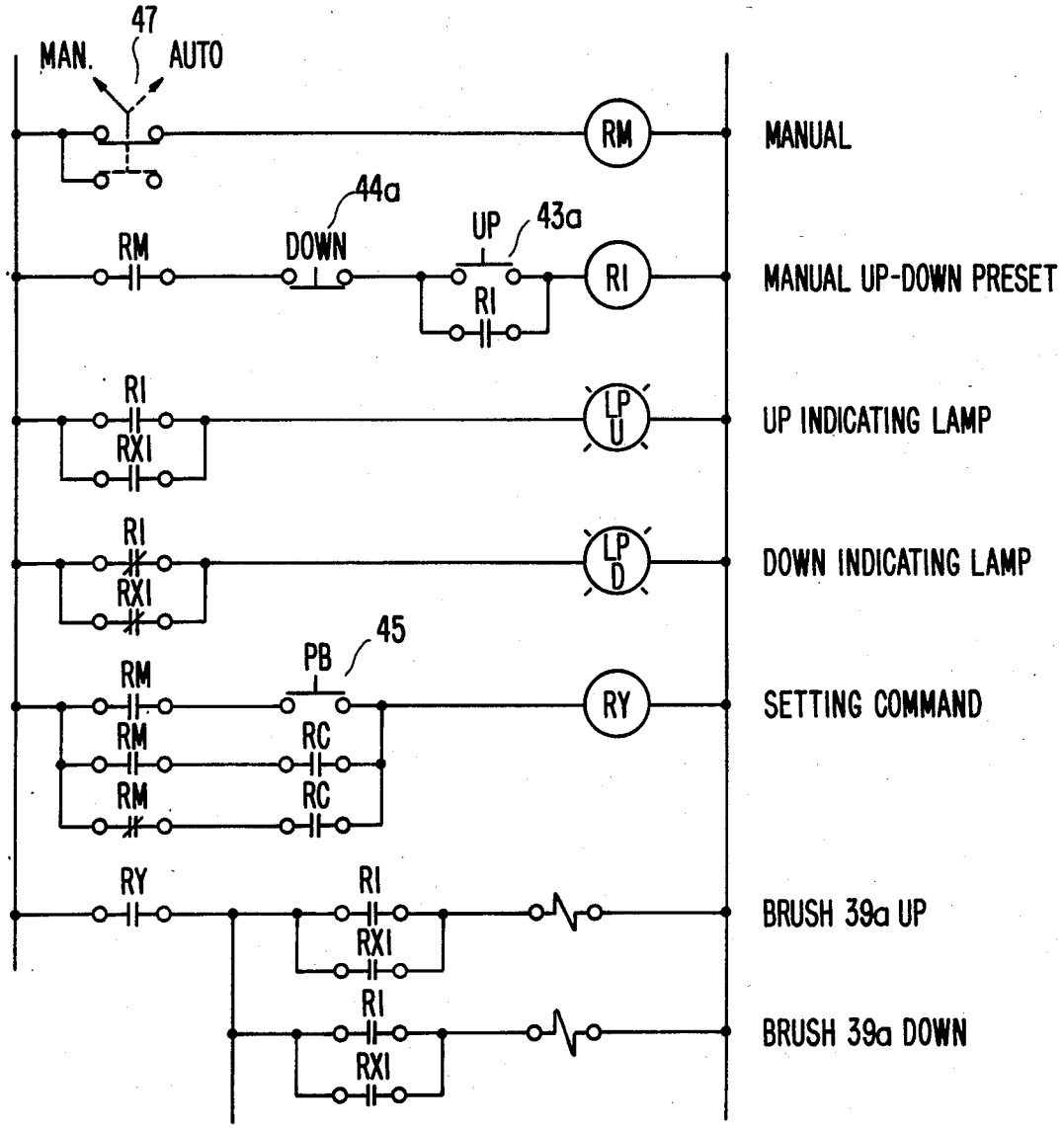
FIG. 6 is a circuit diagram showing a part of a control circuit in FIG. 5.

Braking means disposed above the shingling conveyor 5 will now be described by referring to FIGS. 3 to 6. A plurality of brushes (braking members) **39*a*–39*d* are rotatably supported at their upper end portions to a frame and provided with respective arms at their uppermost ends. The distal ends of the arms are engaged wit the pistons of air cylinders 40*a*–40*d* which are mounted on the frame. The pistons of the air cylinders 40*a*–40*d* are controllably extended or contracted by solenoid valves 41*a*–41*d* to bring the brushes 39*a*–39*d* into an inoperative or operative position, respectively. Designated at 42 is a control panel on which there are disposed UP push buttons with lamps 43*a*–43*d*, DOWN push buttons with lamps 44*a*–44*d*, a manual setting push button 45 and a selector switch 47 for changing over between manual and automatic modes. The control panel 42 includes therein a conrol circuit a part of which serves as a control circuit for the brush 39*a* and is shown in FIG. 6. The selector switch 47 is turned to the manual mode side, whereupon a relay RM is excited. In this state, when the UP push button 43*a* is depressed, a relay R1 is excited to illuminate an UP indicating lamp. Alternatively, when the DOWN push button 44*a* is depressed, the relay R1 is demagnetized to illuminate a DOWN indicating lamp. If the manual setting push button 45 is depressed, a relay RY is excited and an UP or DOWN command is applied to the solenoid valve 41*a* in response to the status of the relay R1. The relay RY is also excited upon input of a cut-off order change command RC. Meanwhile, with the selector switch 47 turned to the automatic mode side, the relay RM is demagnetized and a cut-off length command for the next order is sent from a cut-off control circuit shown in FIG. 5 to a matrix so that a relay RX1 (in FIG. 6) corresponding to the brush 39*a* is excited or demagnetized in response to a cut-off length, whereby an UP or DOWN command for the brush 39*a* is set and the UP or DOWN indicating lamp is illuminated. Then, upon input of the cut-off order change command RC from the cut-off control circut, the brush 39*a* is brought into an UP (inoperative) or DOWN (operative) position in accordance with the above setting. The foregoing is similarly applied to other brushes 39*b*, 39*c* and 39*d***. Note that the spacing between the adjacent brushes is selected to be about 500 mm. Setting of the brushes is performed in accordance with the following table.

| | Cut-off Length | | |
|---|---|---|---|
| | Below 1500 mm | 1500 mm–2000 mm | Above 2000 mm |
| Brush 39a | DOWN | UP | UP |
| Brush 39b | DOWN | DOWN | UP |
| Brush 39c | UP | DOWN | DOWN |
| Brush 39d | UP | UP | DOWN |

The stack section will now be described with reference to FIG. 12. Designated at 25, 27 and 29 are sprockets fixedly provided in position. A hydraulic cylinder 23 has a rod which has its distal end coupled to a table 9 by means of a chain 24 stretched over the sprocket 25. Between the sprockets 25 and 27 is stretched a chain 26. Still another chain 28 is fixed at its intermediate position to the table 9 and is stretched between the sprockets 27 and 29. Thus, the table 9 is moved by means of a solenoid valve 33 for increasing or decreasing the speed of extension and contraction of the rod of the hydraulic cylinder 23 to which is applied hydraulic pressure from a hydraulic pressure source (not shown). The solenoid valve 33 includes a pair of solenoids 30, 31 and, when the solenoid 31 is excited, the hydraulic pressure is imposed on the hydraulic cylinder 23 so that the rod is contracted to raise the table 9. On the other hand, when the solenoid 30 is excited, oil is withdrawn from the hydraulic cylinder 23 so that the rod is extended to lower the table 9. At this time, in response to the magnitude of a signal level from an adjustment means supplied to the solenoid 30, the degree to which the solenoid valve 33 is opened changes and the amount of oil withdrawn from the hydraulic cylinder 23 is also changed, with the result that the descent speed of the table 9 is varied accordingly. Designated at 50, 51 and 52 are photoelectric tubes which are disposed along a side wall of the table 9 in different level positions. When optical paths are interrupted by sheets, the photoelectric tubes 50, 51 and 52 transmit their signals to the adjustment means which comprises a controller 32. The controller 32 transmits to the solenoid 30 a low level signal upon receiving a signal from the photoelectric tube 50 only, a middle level signal upon receiving two signals from both the photoelectric tubes 50, 51 simultaneously, and a high level signal upon receiving three signals from all the photoelectric tubes simultaneously. Such as difference in the signal level varies an excitation amount of the solenoid 30 so that the solenoid valve 33 has a maximum degree of opening with the high level signal, an intermediate degree of opening with the middle level signal, and a minimum degree of opening with the low level signal. In this embodiment, the photoelectric tube 52 is positioned at a level below the upper end of the transfer conveyor 7 by a distance of 10–20 mm, the photoelectric tube 51 is positioned at a level below therefrom by 20–40 mm, and the photoelectric tube 50 is positioned at a level below therefrom by 40–60 mm. The descent speed of the table 9 is set to be 60–100 mm/sec at the maximum degree of opening, 40–60 mm/sec at the intermediate degree of opening, and 20–40 mm/sec at the minimum degree of opening, respectively, of the solenoid 30.

Figure 13:
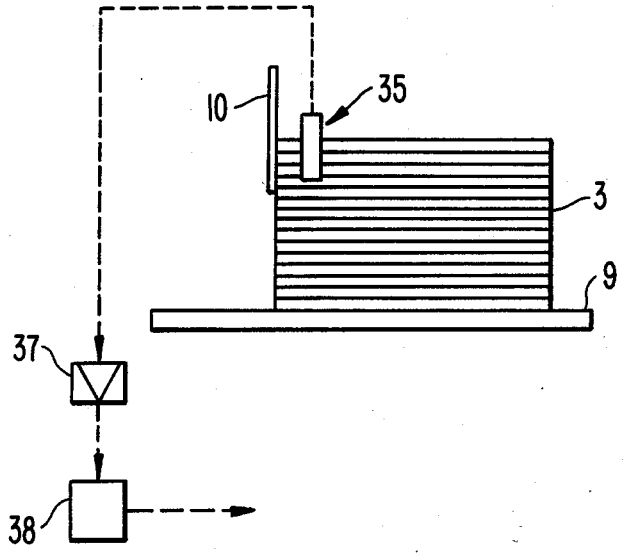
FIG. 13 is a side view showing another embodiment of detection means.
Figure 14:
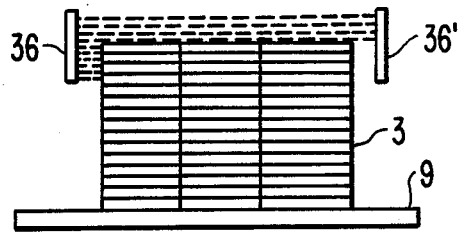
FIG. 14 is a front view of FIG. 13.

Alternatively, the above detection means may be composed of an elongated analog photoelectric tube 35 which is vertically disposed as shown in FIG. 13. The photoelectric tube 35 comprises a light emitting element 36 and a light receiving element 36'. A signal corresponding to an amount of light received by the light receiving element 36' is amplified by a preamplifier 37 and then transmitted as a signal of analog level to the solenoid 30 of the solenoid valve 33 via an amplifier 38. An excitation amount of the solenoid 30 is increased and decreased in response to an analog level of the signal to thereby smoothly change the degree of opening of the solenoid valve 33, so that the descent speed of the table 9 is varied accordingly.

In a normal run mode, as shown in FIG. 2, the sheets 3 cut off by means of a cutter 2 are discharged from the cutter outlet conveyor 4 and drop onto the shingling conveyor 5 while being braked with the brushes 39*a*–39*d*. Since the shingling conveyor 5 is driven a a lower speed than the conveyor 4, the sheets 3 are shingled. The shingled sheets 3 are transferred to the stacker section 8 through the first and second conveyors. The sheets 3 discharged from the second conveyor strike against the front plate 10 and drop downward to be stacked on the table 9.

Figure 12:
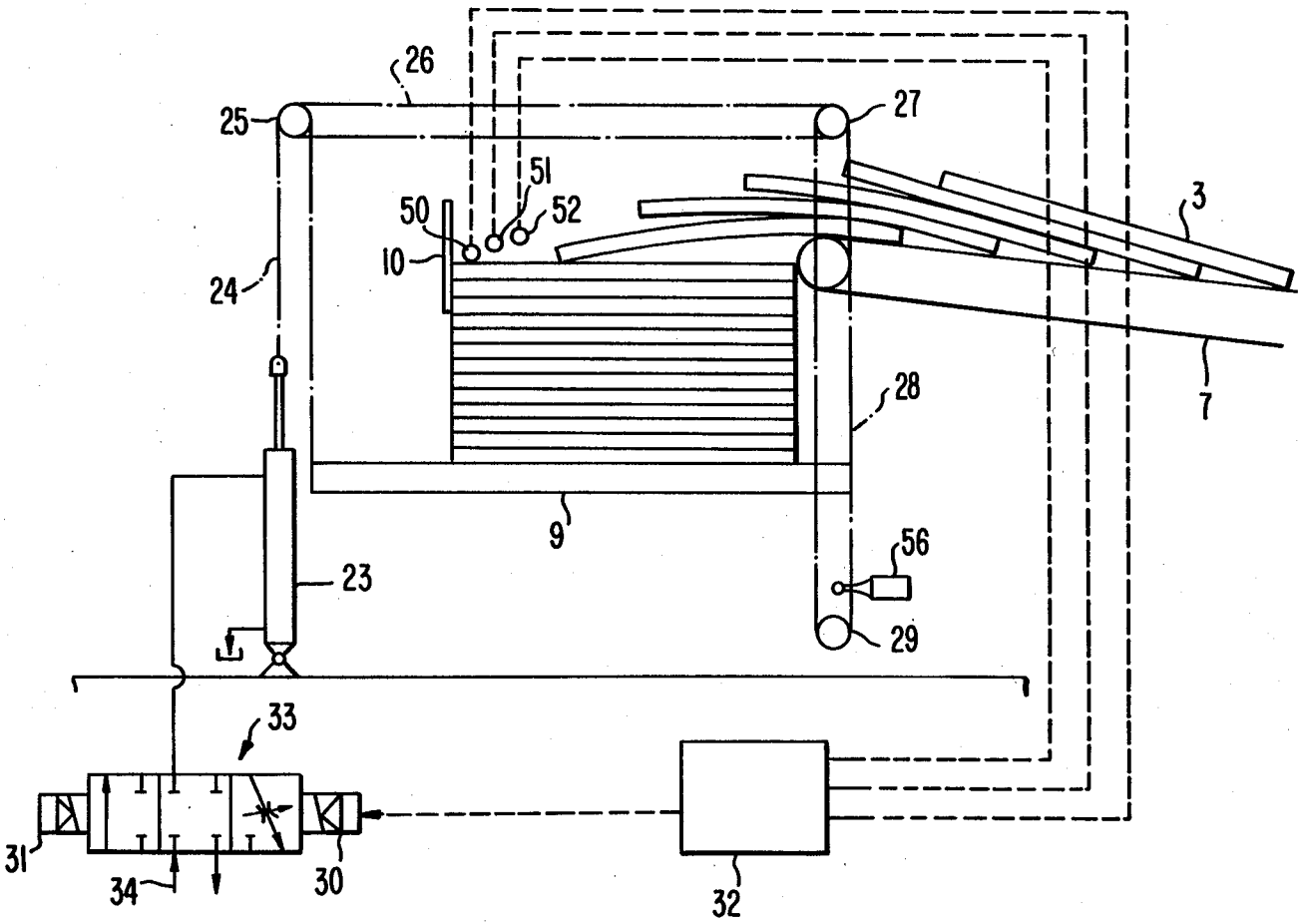
FIG. 12 is an explanatory side view showing the constitution of a stacker section.

At this time, when a large number of sheets 3 are stacked, optical paths of all the photoelectric tubes including the uppermost tube 52 are interrupted to transmit their signals to the controller 32, shown in FIG. 12, which in turn sends a signal of high level to the solenoid 30, so that the solenoid valve 33 assumes the maximum degree of opening and an amount of oil withdrawn from the hydraulic cylinder 23 is enlarged to thereby increase the descent speed of the table 9. When the upper surface of the stacked sheets is lowered and an optical path of the photoelectric tube 52 is released from its interrupted state, the controller 32 transmits a signal of middle level to the solenoid valve 33 in response to light-shield signals from both the photoelectric tubes 51, 50, so that the solenoid valve 33 assumes the intermediate opening degree of opening and the descent speed of the table 9 becomes smaller. Further, when an optical path of the photoelectric tube 51 is also released from its interrupted state, the solenoid valve 33 assumes the minimum degree of opening in response to a light-shield signal from the photoelectric tube 50 only, so that the descent speed of the table 9 becomes still smaller. thus, the descent speed of the table 9 is varied in three steps depending on an amount of stacked sheets and the sheets can be stacked on the table 9 while keeping a fall of the sheets substantially constant.

Figure 7:
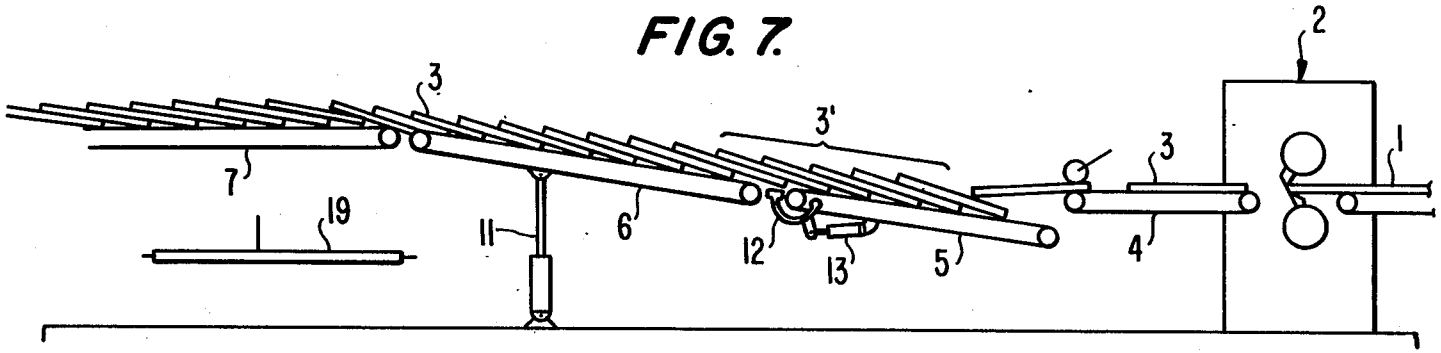
FIGS. 7 to 11 are explanatory views for explaining the operation of removing failed sheets.
Figure 8:
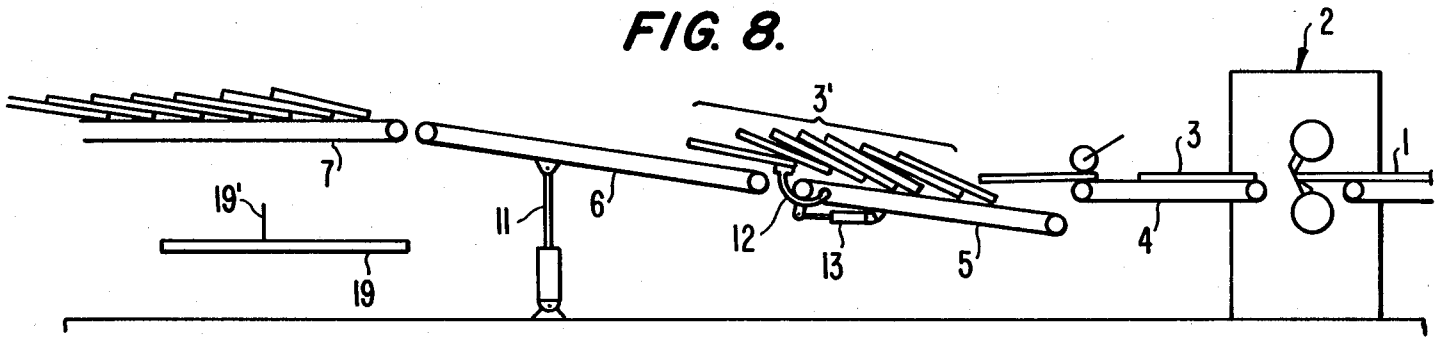
Figure 9:
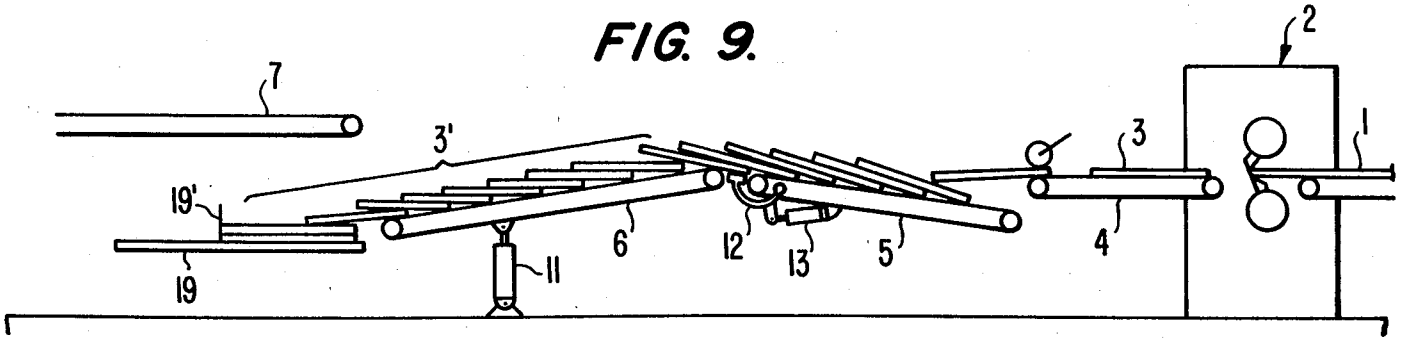
Figure 10:
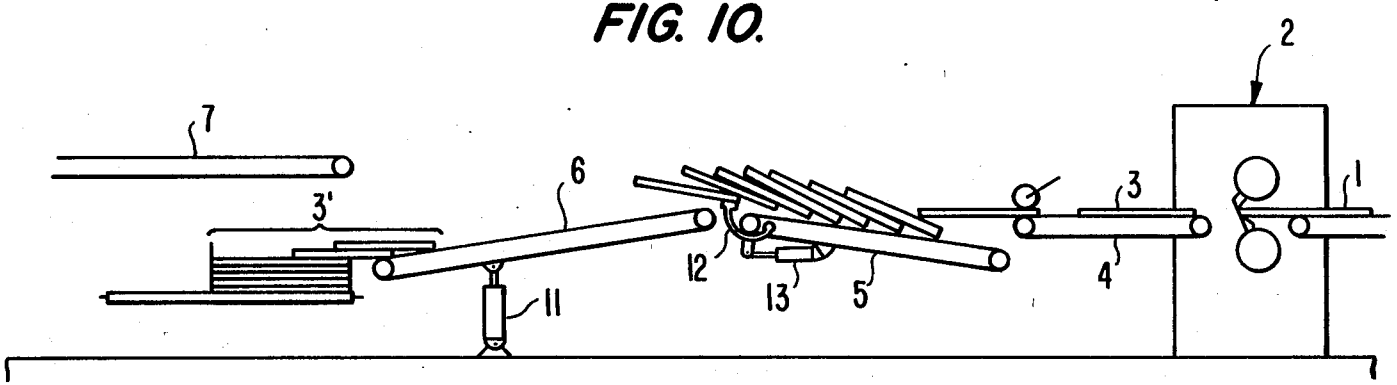
Figure 11:
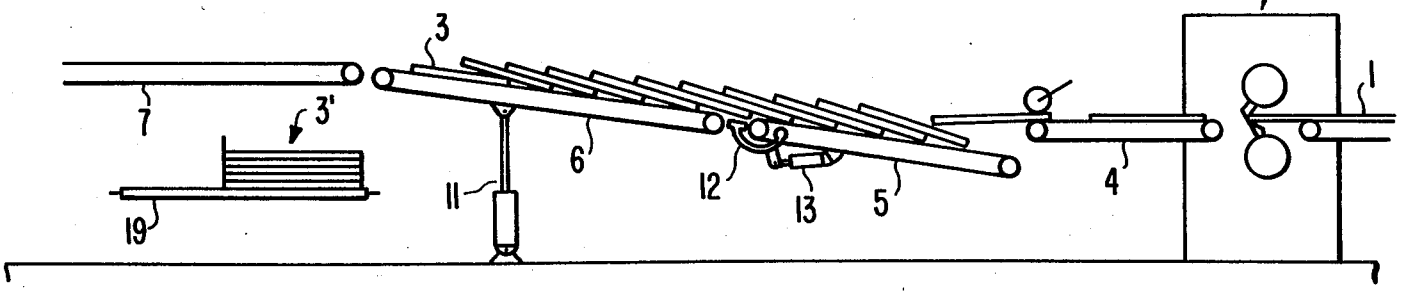

When a predetermined height of sheets is stacked on the table 9, such a stack is ejected to the exterior. An operator stands by the shingling conveyor 5 driven at a smaller sheet transfer speed to monitor mixing of defective sheets. With one or two defective sheets mixed in, he removes them by hand. If the operator finds several defective sheets, he starts the automatic operation of removing a group of defective sheets 3'. First, as shown in FIG. 7, when a rear end of the head sheet in the group of defective sheets 3' reaches a position of the stopper 12, a push button of the push button unit 22 is depressed, whereupon the solenoid valve 15 is excited through the control panel 21 to extend the air cylinder 13, so that the stop 12 is pivoted and its left end is projected into the sheet transfer path to thereby catch the head sheet in the group of defective sheets 3'. At the same time, the motor 16 is deenergized to stop the shingling conveyor 5, and the motors 17, 18 are rotated at a high speed to drive the first and second conveyors 6, 7 also at a high speed, whereby a group of preceding good sheets 3 is quickly transferred. When the tail sheet in the group of good sheets 3 has been transferred to the second conveyor 7 (the state of FIG. 8), the agove push button is depressed again for resetting. With this resetting, the shingling conveyor 5 returns to a normal run mode as mentioned before and the solenoid valve 14 is excited to retract the air cylinder 11, so that the first conveyor 6 is pivoted downward as shown in FIG. 9. As a result, the group of defective sheets 3' is discharged onto the discharge conveyor 19 from the first conveyor 6. Then, when the tail sheet in the group of defective sheets 3' has passed the stopper 12 (the state of FIG. 9), the push button of the push button unit 22 is depressed once again to turn ON. Upon this, similarly to the above, the stopper 12 is projected to catch the head sheet in the next group of good sheets and, simultaneously, the shingling conveyor 5 is stopped and the first conveyor 6 is driven at a high speed, so that the group of defective sheets 3' is discharged onto the discharge conveyor 19 (the state of FIG. 10). After the group of defective sheets 3' has been completely discharged, the push button is reset once again. As a result, the stopper 12 is retracted and, at the same time, the shingling conveyor 5, the first conveyor 6 and the second conveyor 7 are all returned to a normal run speed and the solenoid valve 14 is demagnetized to extend the air cylinder 11, so that the first conveyor 6 is pivoted upward to return to the original position, thereby resuming a normal run mode (the state of FIG. 11) to transfer the good sheets to the stacker section and stack the sheets therein. During this time, the discharge conveyor 19 is driven by the motor 20 so as to discharge the defective sheets to the exterior. In this manner, the defective sheets can be removed positively and easily.

Then, after completion of the certain order, when the cut-off order change command RC is transmitted to change a cut-off length of sheet for shifting to the next order, the respective brushes are automatically brought into the preset positions as mentioned above. Accordingly, the brushes can be changed over at the precise timed relationship and hence it becomes possible to prevent the sheets from becoming disordered, folding or jamming at the shingling conveyor.

What is claimed is:

1. A sheet stacker for a corrugation machine which widthwisely cuts off a continuously manufactured corrugated cardboard web with a cutter into corrugated cardboard sheets, and transfers, stacks and ejects said sheets, comprising:

(a) a shingling conveyor arranged downstream of an outlet of said cutter for shingling said sheets;

(b) braking means arranged above said shingling conveyor for regulating a shingling length of the sheets on said shingling conveyor by braking the sheets transferred from said cutter;

(c) a first transfer conveyor arranged downstream of said shingling conveyor, said first transfer conveyor being vertically pivotable about end portions on the upstream side thereof for moving a downstream end thereof vertically downward to allow removal of defective sheets from said first conveyor;

(d) stopper means disposed between said shingling conveyor and said first transfer conveyor for selectively stopping sheets conveyed on said first transfer conveyor;

(e) at least one second transfer conveyor arranged downstream of said first transfer conveyor;

(f) sheet stacking means disposed downstream of said second transfer conveyor, said sheet stacking means being vertically movable for receiving said stacking the sheets discharged from said second transfer conveyor;

(g) drive means for moving said sheet stacking means up and down at a variable speed; and (h) adjustment means for automatically controlling said drive means in response to the magnitude of a sheet stacking speed to thereby adjust a descent speed of said sheet stacking means.

2. A sheet stacker according to claim 1, wherein said braking means comprises a plurality of brushes arranged in the direction of running of the sheets with certain intervals therebetween, and moving means disposed corresponding to each of said respective brushes for independently bringing each of said brushes into either an operative position or an inoperative position.

3. A sheet stacker according to claim 2, further including means for driving said corresponding moving means in response to a cut-off order change signal to change a cut-off length of said cutter and then for setting each of said brushes into an operative or inoperative position in accordance with a cut-off length of sheets.

4. A sheet stacker according to claim 1, wherein said shingling conveyor and said first transfer conveyor are each separately driven by motors which are independently adjustable in their rotational speeds.

5. A sheet stacker according to claim 1, further including a plurality of sheet detection means each of which is disposed above said sheet stacking means and spaced vertically from one another, said plurality of detection means being positioned adjacent a downstream end of said second transfer conveyor so as to detect the presence or absence of sheets on said sheet stacking means, said adjustment means controlling said drive means for adjusting a descent speed of said sheet stacking means in response to detection signals from said plurality of sheet detection means.

6. A sheet stacker according to claim 5, wherein said plurality of sheet detection means comprise a plurality of photoelectric tubes.

7. A sheet stacker according to claim 1, further including a sheet detection means comprising a single vertically elongated analog type photoelectric tube disposed above said sheet stacking means and positioned adjacent a downstream end of said second transfer conveyor so as to detect the presence or absence of sheets on said sheet stacking means, said adjustment means controlling said drive mans for adjusting a descent speed of said sheet stacking means in response to detection signals from said sheet detection means.

8. A sheet stacker according to claim 1, further comprising a discharge conveyor for defective sheets, said discharge conveyor being positioned below said second conveyor and adapted to receive sheets from said first conveyor when said first conveyor is pivoted to vertically move the downstream end thereof to a position adjacent said discharge conveyor whereby defective sheets may be transferred from said first conveyor to said discharge conveyor.

9. A sheet stacker according to claim 1, wherein said drive means for said sheet stacking means comprises a hydraulic cylinder having an extendible rod which is connected by suitable means to a table of said sheet stacking means, said hydraulic cylinder being connected to valve means electrically connected to said adjustment means and operable in response to signals received from said detection means through said adjustment means to increase or decrease the speed of extension or contraction of said rod and thereby vary the descent speed of said table.

10. A sheet stacker according to claim 9, further including a plurality of detection means each of which is electrically connected to said adjustment means, each of said plurality of detection means being spaced vertically from one another above said sheet stacking means at a position downstream of said second transfer conveyor for detecting the presence or absence of sheets on said sheet stacking means, whereby said valve means varies the descent speed of said table in response to signals received from said adjustment means.

* * * * *